US007806272B2

(12) United States Patent
Al-Hasan

(10) Patent No.: US 7,806,272 B2
(45) Date of Patent: Oct. 5, 2010

(54) MAGNETIC SWEEPER

(76) Inventor: Khaled Jafar Al-Hasan, 1680, Safat 13017 (KW)

( * ) Notice: Subject to any disclaimer, the term of this patent is extended or adjusted under 35 U.S.C. 154(b) by 0 days.

(21) Appl. No.: 12/390,534

(22) Filed: Feb. 23, 2009

(65) Prior Publication Data

US 2010/0213108 A1 Aug. 26, 2010

(51) Int. Cl.
*B03C 1/00* (2006.01)
*B07B 1/49* (2006.01)

(52) U.S. Cl. ..... 209/215; 209/417; 209/418; 209/419; 209/420

(58) Field of Classification Search ..... 209/215, 209/417, 418
See application file for complete search history.

(56) References Cited

U.S. PATENT DOCUMENTS 2,654,480 A * 10/1953 Stem ..... 209/215
2,693,279 A * 11/1954 Box et al. ..... 209/215
3,646,492 A * 2/1972 Westermann ..... 335/285
6,113,169 A * 9/2000 Gohman et al. ..... 294/65.5
6,158,792 A * 12/2000 Snider ..... 294/65.5
6,334,538 B1 * 1/2002 Nettles ..... 209/418
6,592,161 B1 * 7/2003 Hsiao ..... 294/65.5
7,044,520 B2 * 5/2006 Roberson et al. ..... 294/55.5
D527,858 S * 9/2006 Van Cleave et al. ..... D34/24
7,331,470 B2 * 2/2008 Vernon et al. ..... 209/417

* cited by examiner

*Primary Examiner*—Gene Crawford
*Assistant Examiner*—Terrell H Matthews
(74) *Attorney, Agent, or Firm*—Lowe Hauptman Ham & Berner, LLP

(57) ABSTRACT

A magnetic sweeper includes an upper body portion and a base assembly disposed below the upper body portion and a frame. The body defines a cavity with an open bottom portion. The base assembly includes a non-magnetizable frame and a magnetizable plate supported by the frame and a non-magnetizable collection basket disposed below and offset from the magnetizable plate. A pair of wheels and handle are provided for guiding and propelling the sweeper over a selected area of ground. In addition, the sweeper includes a battery and a solar cell for charging and recharging the battery as well as a pair of coils connected to the battery for generating a magnetic field to thereby magnetize the plate to attract ferro-metallic debris. Further, a mechanism is provided for dropping the ferro-metallic material into a collection basket.

5 Claims, 6 Drawing Sheets

MAGNETIC SWEEPER

FIELD OF THE INVENTION

This invention relates to a magnetic sweeper and more particularly to a magnetic sweeper that employs a magnetic field for picking up ferro-metallic materials.

BACKGROUND FOR THE INVENTION

Magnetic sweepers are well known and have been in use for many years to clear an area of ferro-metallic materials as for example nails and the like from a construction site. Such sweepers have achieved wide spread use and there has been a continuing effort to improve on apparatus that use magnetic attraction for collecting ferro-metallic debris.

For example, a U.S. Patent of Vernon et al. No. 7,331,470 discloses a magnetic raking device that agitates a ground surface and uses magnetic attraction for collecting ferro-metallic debris such as nails and screws, at construction job-sites and other locations. The apparatus includes a release mechanism that temporarily eliminates magnetic attraction of the debris to the rake, thus allowing collected debris to drop from the rake, such as into a trash or recycling container. One type of release mechanism physically removes one or more magnets from the rake body to eliminate magnetic attraction to the rake body. Another type of release mechanism uses electromagnets in the rake body that attract ferro-metallic debris when current is allowed to run through the electromagnets, and that allows the debris to drop from the rake when the current is interrupted. The magnetic rake may be used in an inverted position to attract ferro-metallic debris without agitating soil, and may be used in a non-magnetic state as a conventional rake.

A more recent approach to a magnetic sweeper is disclosed in a U.S. Patent Application Publication No. 2008/0078698 A1 of Lin et al. As disclosed therein a magnetic sweeper is configured to collect magnetic metal debris such as nails, screws, sheet metal fragments, staples, rivets and the like from a surface, and to permit easy removal of the collected debris from the sweeper. The sweeper comprises a non-metallic body, a permanent magnet disposed within the body, a non-metallic cover hingeably mounted to the underside of the body and an integrated latch configured to removably secure the cover to the body. The sweeper is configured to removably engage a handle for controlling the sweeper, and in another embodiment, an extendable telescoping extender may be connected between a coupler and the handle to permit the sweeper to be used in a wide variety of locations. Preferably, the sweeper body is configured to swivel upon application of torque to the handle. In use, the sweeper is passed over metallic debris using the handle to guide the body. As the body passes over such debris, the magnet attracts the debris and holds it against the outer surface of the cover. When debris collection is complete, the cover is unlatched from the body and swung outwardly from the body, thereby displacing the collected debris to a location outside of the magnetic field of the magnet and permitting the debris to fall away from the cover.

Notwithstanding the above, it is presently believed that there is a need and a commercial market for a magnetic sweeper in accordance with the present invention. There should be a need for such sweepers because they are relatively easy to use, include a solar cell for recharging a rechargeable battery, are self contained, relatively compact, easy to use and service and can be manufactured and sold at a competitive cost.

The sweepers in accordance with the present invention is also designed to precede an individual which minimizes the likelihood of the individual being scratched or punctured with metallic debris and at the same time is easy to clean. Further, the sweepers in accordance with the present invention include a collection receptacle or basket which allows an individual to sweep a relatively large area without the need to return to a disposal site or trash bin.

BRIEF SUMMARY OF THE INVENTION

In essence, a magnetic sweeper to pick up and collect ferro-metallic materials includes a non-magnetizable frame such as a uni-body construction or tubular aluminum structure, a non-magnetizable body of aluminum, plastic or other material including an upper body and a base assembly disposed on the frame below the upper body. The upper body has a top portion, an open bottom portion, a forward portion, a rear portion, two sides and defines a cavity above the open bottom portion. A magnetizable/de-magnetizable plate is supported by the non-magnetizable frame. In addition, a non-magnetizable plastic collection receptacle is disposed below the magnetizable plate and offset therefrom.

The sweeper in accordance with the present invention also includes a pair of wheels with one of the wheels disposed on each of the two sides of the upper body. The wheels are constructed and arranged to support the upper body in an upright position for transporting the sweeper over a pre-selected area of ground with the magnetizable plate essentially parallel to and proximate to a selected area of ground. For example, the plate may be positioned at from about one to three inches above the ground so that the magnetized plate will attract and hold the magnetizable material. A manually guidable handle is connected to the sweeper and extends upwardly and rearwardly therefrom for pushing and guiding the sweeper over the pre-selected area of ground. A battery and a solar cell for charging and recharging the battery and a pair of coils are connected to the battery for magnetizing the plate to thereby attract ferro-metallic materials to the plate.

Further, the sweeper in accordance with the preferred embodiment of the invention includes means for depositing ferro-metallic materials in a basket as well as means for returning the magnetic plate away from the collection means for picking up additional material.

The invention will now be described in accordance with the following figures wherein like numbers have been used to illustrate like parts.

DETAILED DESCRIPTION OF THE INVENTION

Figure 1:
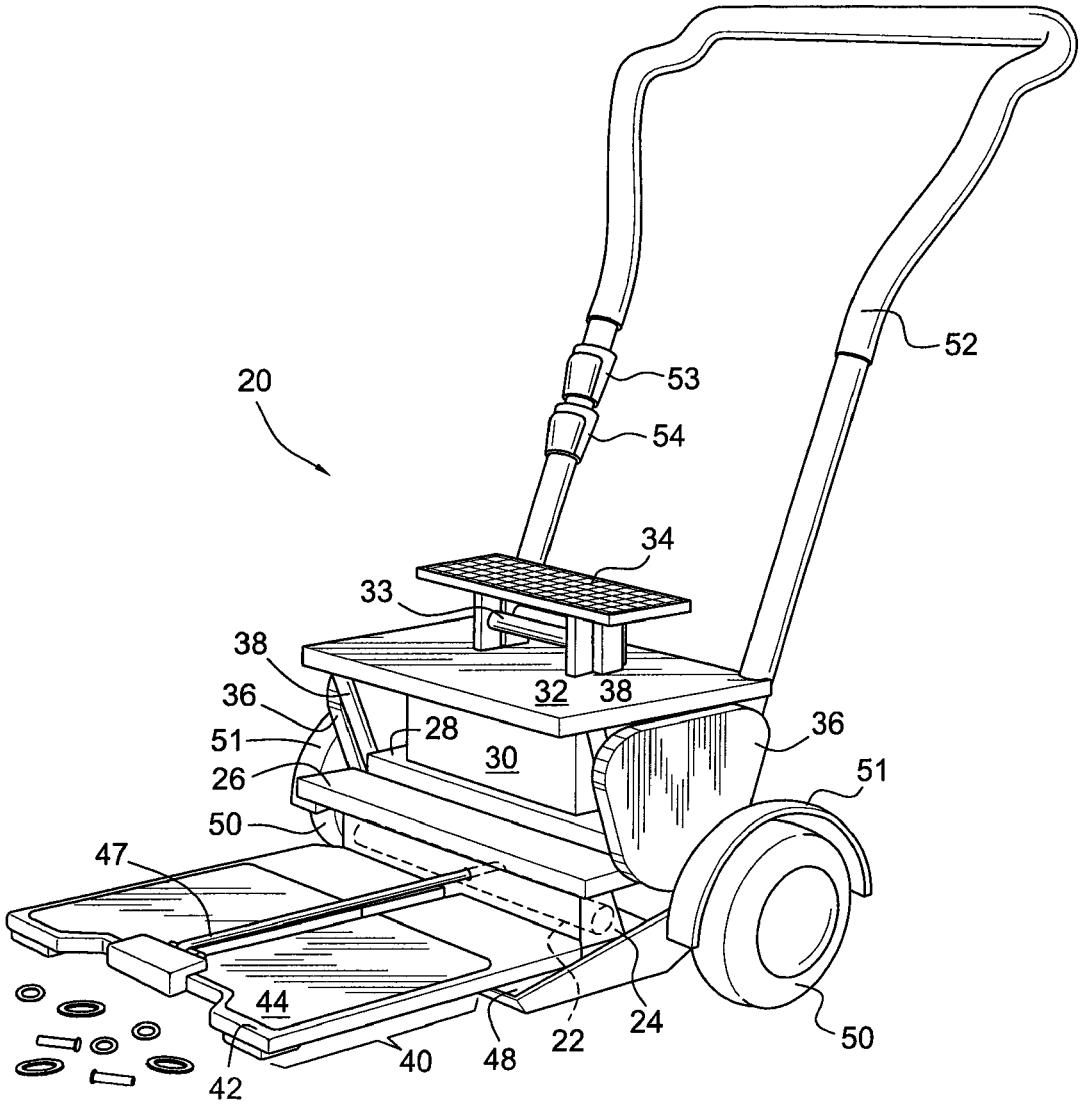
FIG. 1 is a perspective view of a magnetic sweeper in accordance with a preferred embodiment of the invention.
Figure 2:
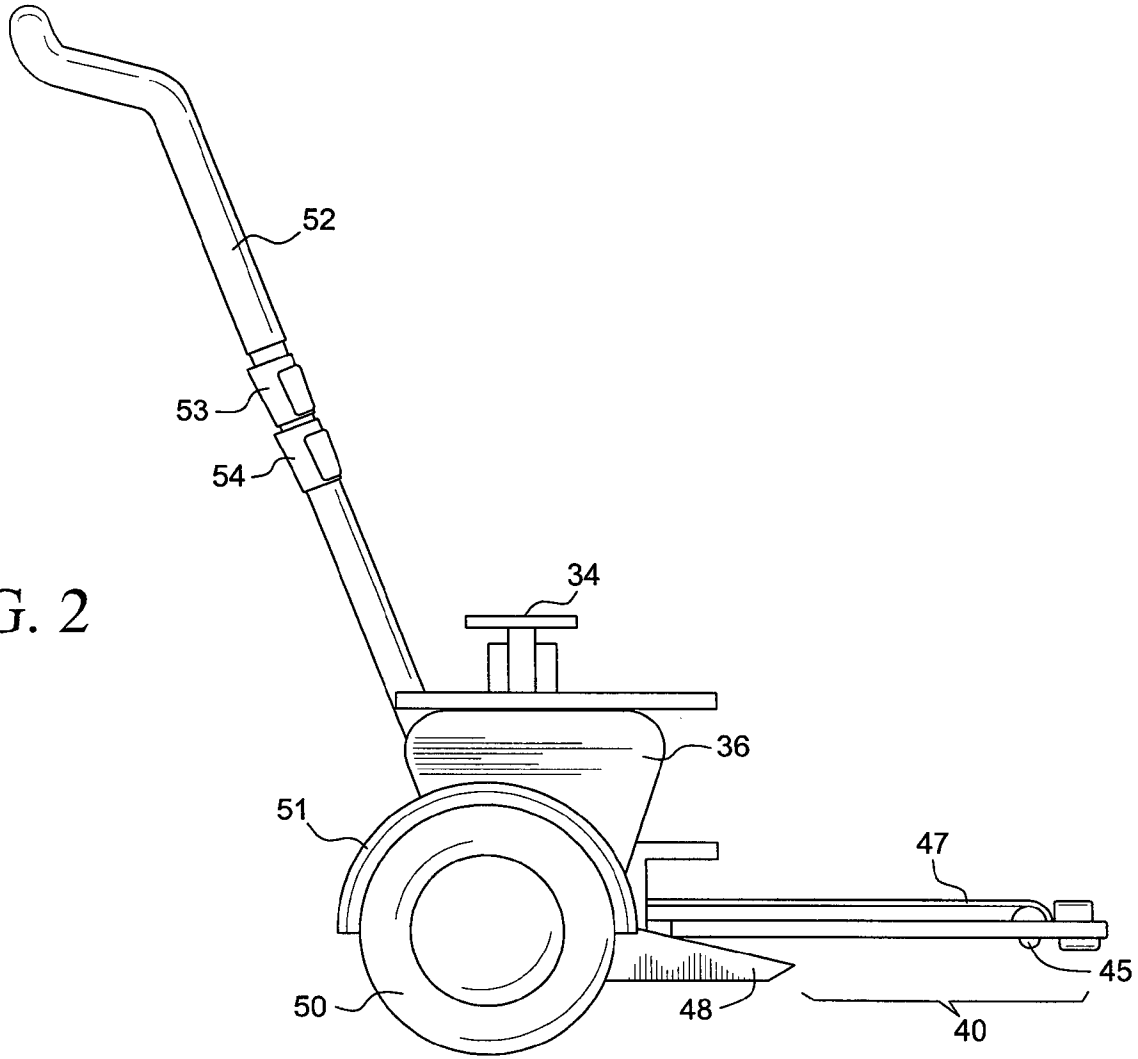
FIG. 2 is a side view of a ferro-metallic sweeper as shown in FIG. 1.
Figure 3:
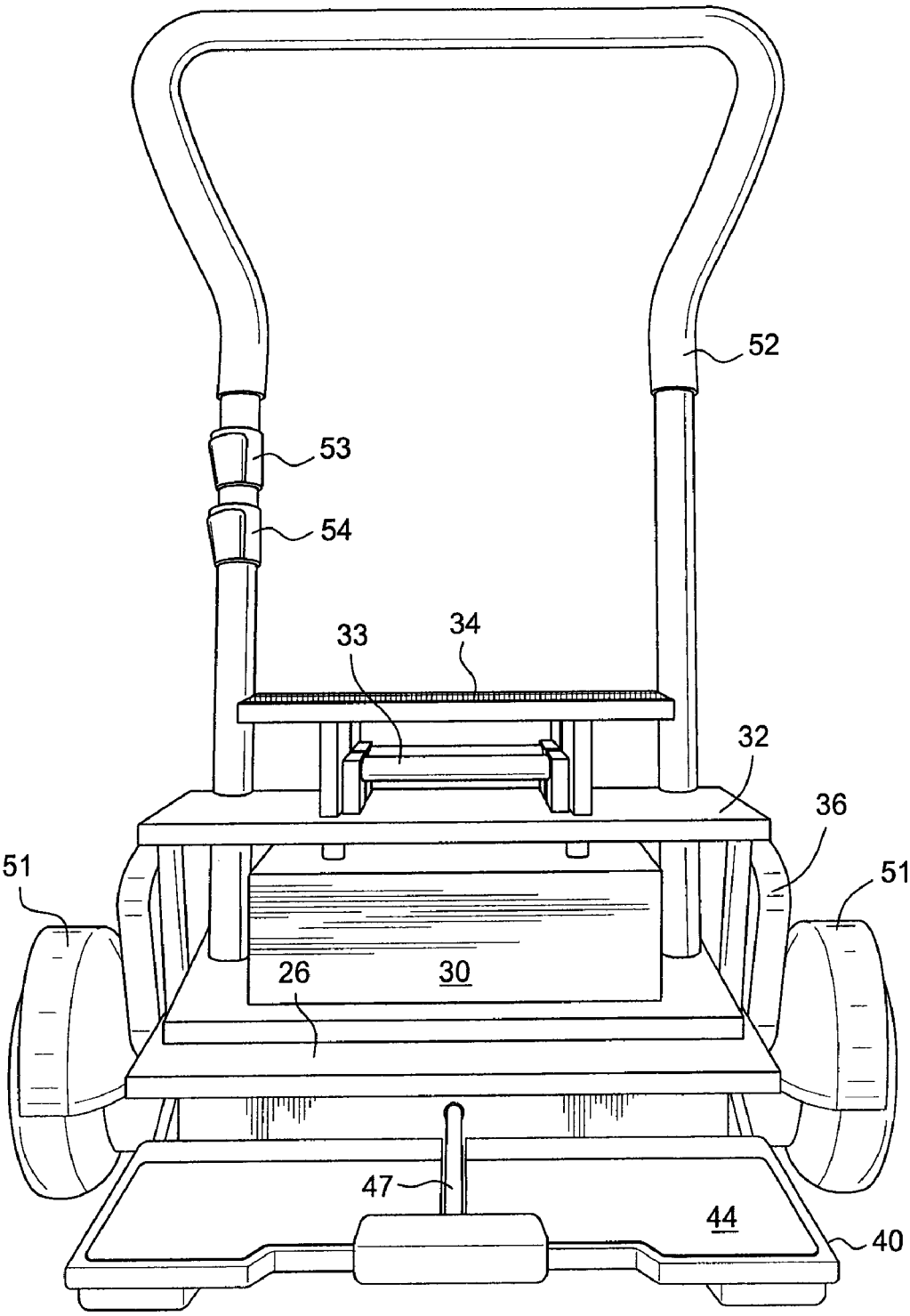
FIG. 3 is a front view of the magnetic sweeper shown in FIGS. 1 and 2.
Figure 4:
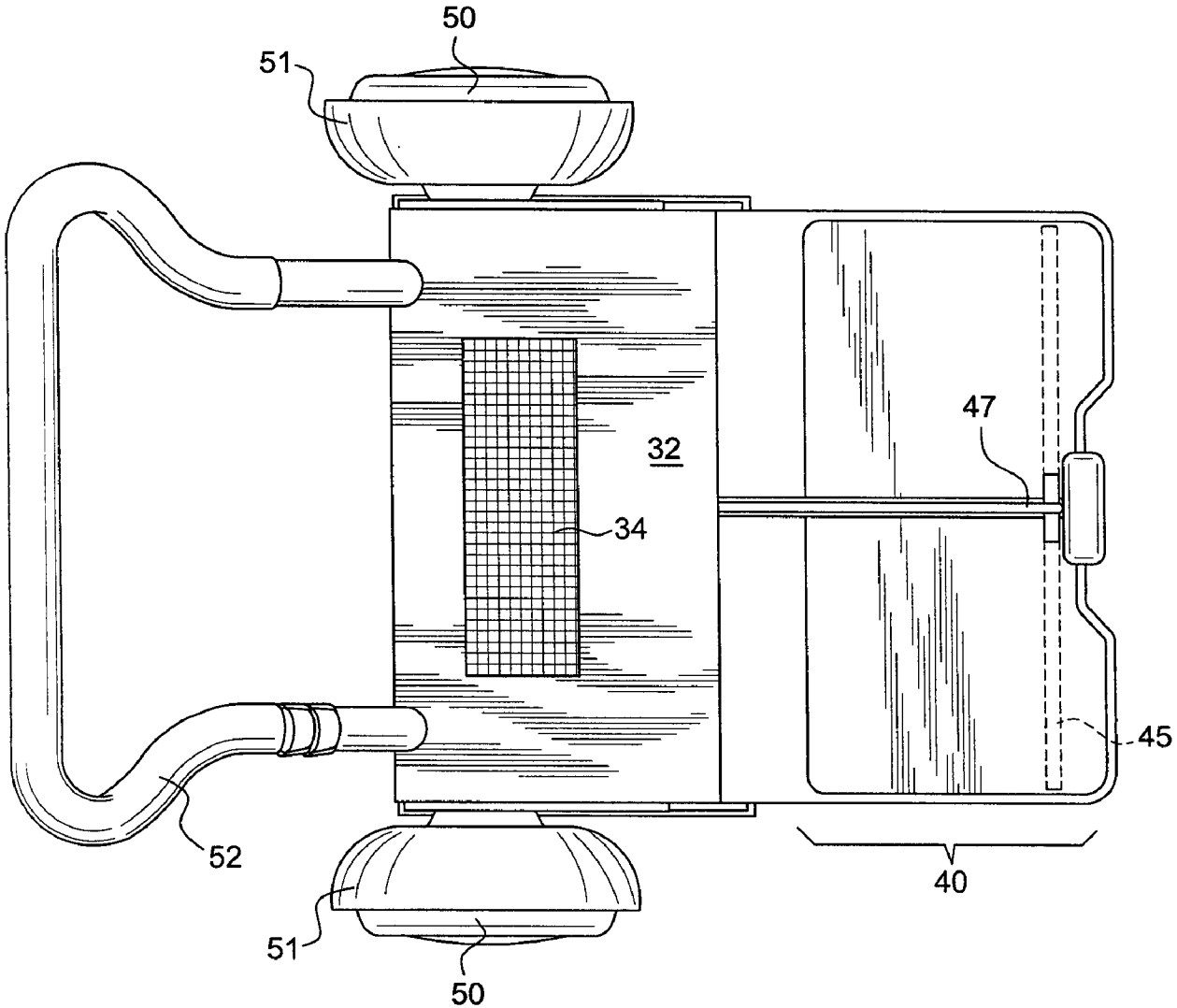
FIG. 4 is a top or plan view of the ferro-metallic sweeper as shown in FIGS. 1, 2 and 3.
Figure 5:
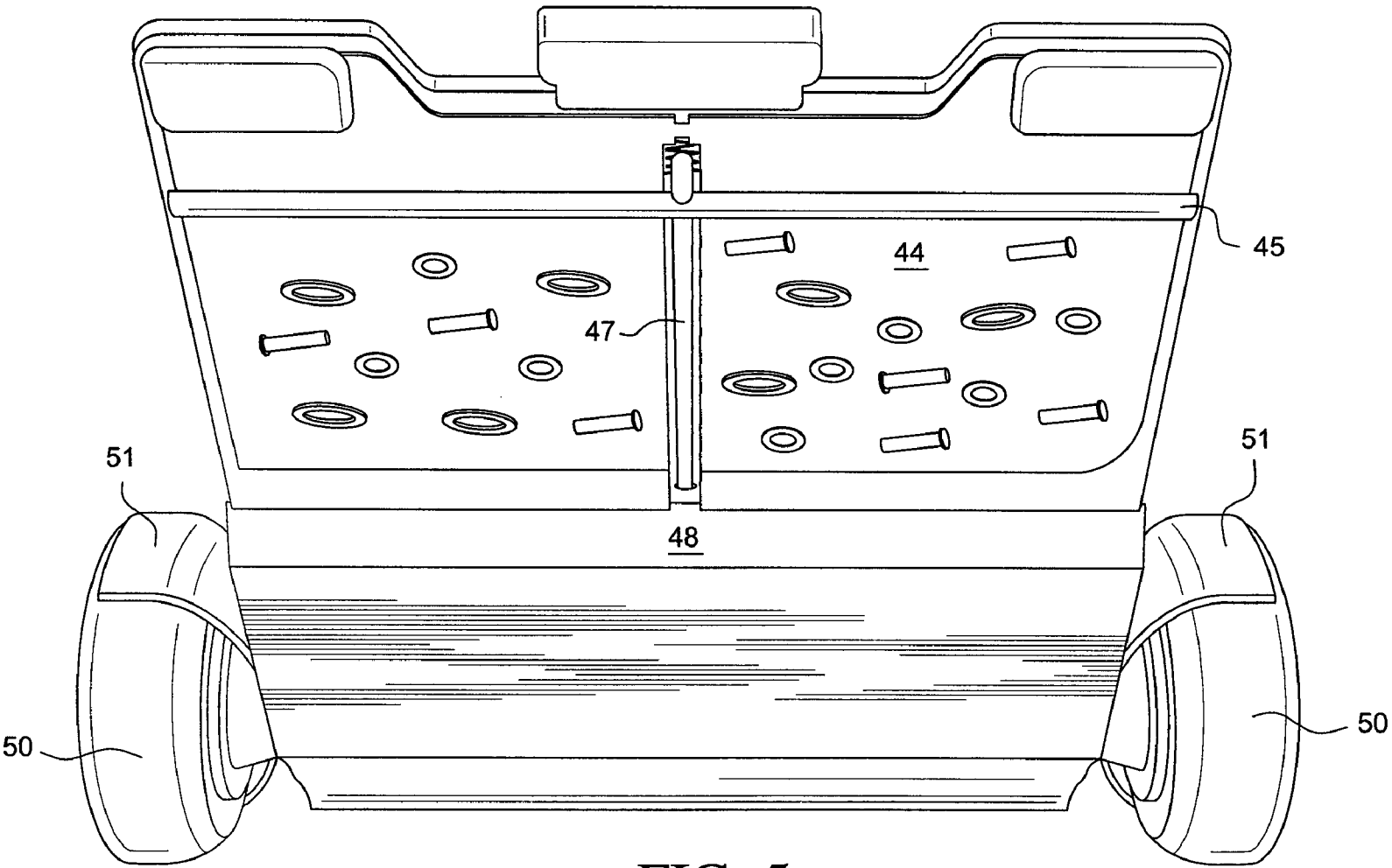
FIG. 5 is a bottom view of a magnetic sweeper in accordance with the invention that illustrates a magnetizable/de-magnetizable plate with ferro-metallic materials attached thereto and a sweeper blade for transferring the ferro-metallic materials to a non-magnetizable container or basket.
Figure 6:
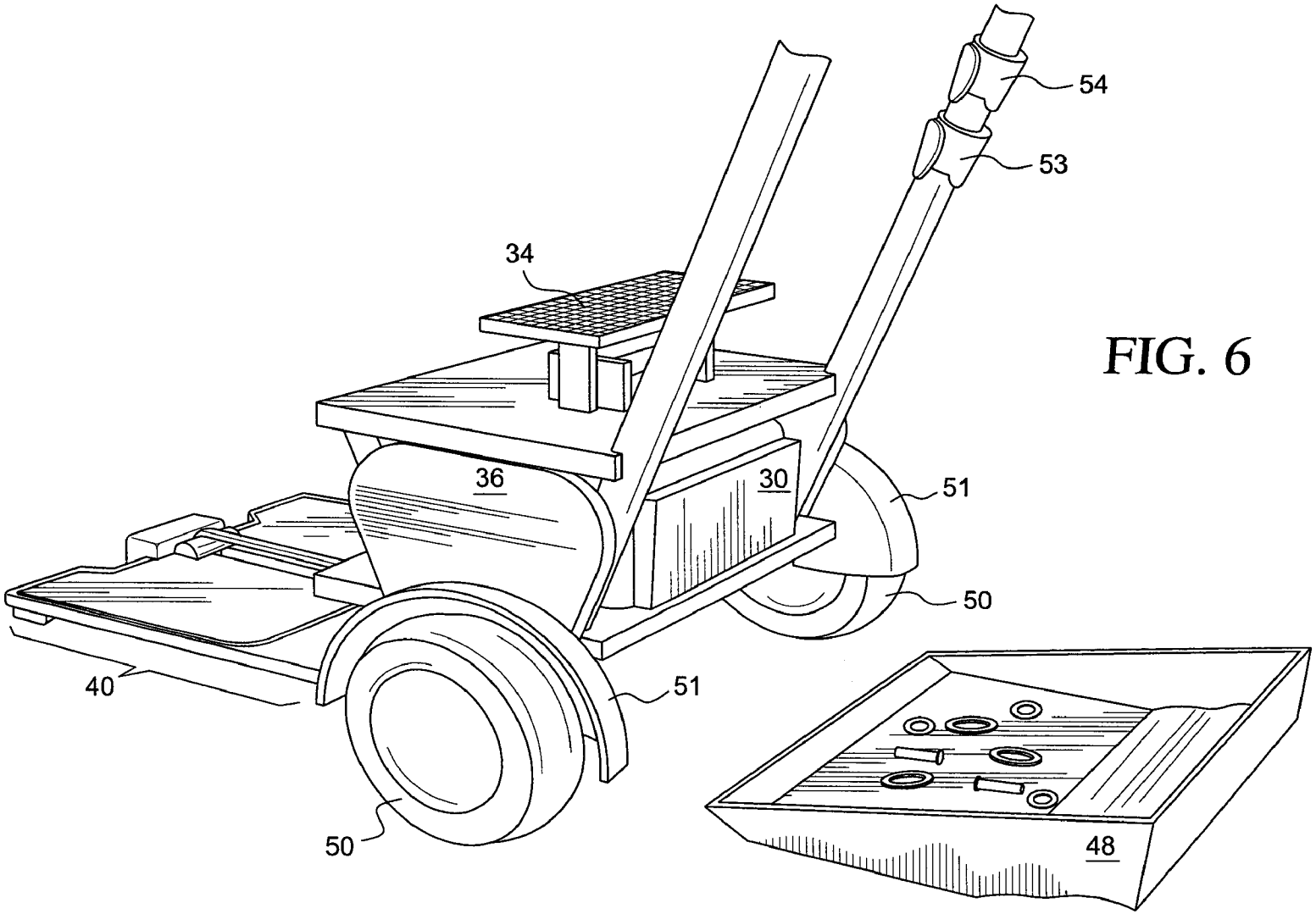
FIG. 6 is a perspective view of a magnetic sweeper with a non-magnetic container removed therefrom.

A magnetic sweeper 20 in accordance with a preferred embodiment of the invention is illustrated in FIGS. 1-4 wherein a frame 22 is made of aluminum or plastic tubing that forms a base of the structure upon which the sweeper is constructed or built. It is also contemplated that the sweeper 20 may be built or assembled with a "uni-body" construction i.e. with an integral or virtual frame wherein the various body parts are constructed and dimensioned to serve as the frame as will be well understood by persons of ordinary skill in the art.

As illustrated the magnetic sweeper 20 includes a plastic body built around the frame 22 that serves as a cross member together with a hollow plastic tubular element 24 that surrounds the frame 22 and supports and/or is fixed to a generally horizontal platform 26. The horizontal platform 26 also is fixed to a battery support 28 for supporting a battery 30 that is used together with one or more coils 33 to generate a magnetic field in a conventional manner. The coils 33 are shown schematically below the solar panel 34. However, in the preferred embodiment of the invention the coils will be disposed adjacent a magnetic plate.

The plastic body also includes a generally horizontal top or upper plate like support member 32 or cover that extends over the battery 30 and supports a solar panel 34 for recharging the battery 30.

A pair of upwardly extending side members 36 extend upwardly from the horizontal platform 26 and battery support 28 to support the upper plate like support member 32 and forms a ridged structure with platform 26 and support 28. As shown in FIG. 1 the side member 36 may include inner supports 38 to add rigidity to the assembly.

An important part of the magnetic sweeper 20 in accordance with the present invention resides in the forwardly extending pick-up member 40 that extends forwardly of the body of the sweeper 20. The forwardly extending pickup member 40 includes a non-magnetizable plastic frame 42 that supports a magnetizable/demagnetizable plate 44. The plate 44 is disposed above the ground by about 2-4 inches so that it picks up ferro-metallic debris and holds the picked up debris against the plate as the sweeper 20 passes over the ground.

The forwardly extending pickup member 40 also includes a sweeper bar 45 (Sees FIGS. 2 and 4) and means for dragging the sweeper bar 45 (See FIG. 4) rearwardly across the magnetizable plate 44 to scrape the blade 44 clear by moving the ferro-metallic debris rearwardly until it is pulled past the rear edge of the plate 44. At this point, the ferro-metallic debris falls into a non magnetizable plastic container or basket 48.

The sweeper 20 also includes a pair of wheels 50 and fenders 51 for supporting the sweeper 20 and for moving the sweeper 20 across an area for removal of ferro-metallic debris. A handle 52 includes a pair of switches 53 and 54 for connecting the battery 30 to the coils 33 to create a magnetic field to magnetize the plate 44. The second switch 54 is used to recharge the battery 30 by connecting it to the solar cell 54. The electrical connection and/or circuitry for generating a magnetic field are conventional in design and will be well understood by those of ordinary skill in the art.

While the invention has been described in connection with the accompanying drawings it should be recognized that changes and modifications may be made therein without departing from the scope of the appended claims.

What is claimed is:

1. A magnetic sweeper to pick up and collect ferro-metallic materials, said magnetic sweeper comprising:

a non-metallic body including an upper body and a base assembly disposed below said upper body, said upper body having a top portion, an open bottom portion, a forward portion, a rear portion, two sides and defining a cavity above said open bottom portion;

a non-magnetizable plastic collection receptacle disposed below said upper body and offset therefrom;

a forwardly extending pickup member that extends forwardly of said body and includes:

i. A generally flat horizontal magnetizable/demagnetizable plate disposed between 2" to 4" above the ground for picking up ferro-metallic debris and holding the picked up debris against said plate as the sweeper passes over the ground, and a non-magnetizable plastic frame supporting said magnetizable/demagnetizable plate;

ii. A sweeper bar and means for dragging said sweeper bar rearwardly against said magnetizable/demagnetizable plate to thereby move the ferro-metallic debris rearwardly until it is pulled passed a rear edge of the magnetizable/demagnetizable plate to fall into said plastic container;

a pair of wheels with one of said wheels disposed on each of said two sides of said upper body and said two wheels constructed and dimensioned to support said upper body in an upright portion for transporting said sweeper over a pre-selected area of ground with said magnetizable plate essentially parallel to and proximate to said selected area of ground;

a manually guidable handle connected to said sweeper and extending upwardly and rearwardly therefrom for pushing and guiding said sweeper over the pre-selected area of ground;

a battery and a solar cell for charging and recharging said battery and a coil operatively connected to said battery for magnetizing said magnetizable/demagnetizable plate to thereby attract ferro-metallic materials to said plate; and means for depositing ferro-metallic materials in said receptacle and for removing said plate from over said receptacle.

2. A magnetic sweeper according to claim 1 in which said sweeper has a uni-body construction.

3. A magnetic sweeper according to claim 1 in which said means forming a non-magnetic frame is made from aluminum tubes.

4. A magnetizable sweeper according to claim 1 in which said means forming a non-magnetic frame is made of a rigid plastic.

5. A magnetic sweeper to pick up and collect ferro-metallic materials, said magnetic sweeper consisting of:

a non-magnetic plastic body including an upper body, and a base assembly disposed below said upper body;

said upper body having a top portion, an open bottom portion, a forward portion, a rear portion, two sides and defining a cavity above said open bottom portion;

means including said upper body and said base forming a virtual frame in a uni-body construction;

a forwardly extending pickup member that extends forwardly of said upper body;

a generally flat horizontal magnetizable plate, a non-magnetizable frame supports said magnetizable plate and a non-magnetizable collection basket disposed below said magnetizable plate and offset therefrom;

a sweeper bar and means for dragging said sweeper bar rearwardly across said magnetizable plate to thereby move the ferro-magnetic debris rearwardly until it is pulled past a rear edge of said magnetizable plate and falls into said plastic container;

a pair of wheels with one of said pair of wheels disposed on each side of said sweeper for supporting and moving said sweeper over a pre-selected area of ground in a generally upright position;

a manually guidable handle extending upwardly and rearwardly of said plastic body for guiding and propelling said sweeper over a pre-selected area of ground with said magnetizable plate essentially parallel to and proximate to said selected areas of ground;

a rechargeable battery and a solar cell for charging and recharging the battery and a pair of coils operatively connected to the battery for generating a magnetic field to thereby magnetize said magnetizable plate to attract ferro-metallic materials to said plate;

means for moving ferro-metallic materials from said plate over said non-magnetizable plastic basket and a sweeper arm for pushing the ferro-metallic material off of said plate to fall into said non-magnetizable plastic basket and a spring for returning said plate away from said basket and into a pick up position; and means for removing said basket from said sweeper to empty the basket of the debris.

* * * * *